US005176092A

United States Patent [19]

Czimmek

[11] Patent Number: 5,176,092

[45] Date of Patent: Jan. 5, 1993

[54] ICEBREAKER BOW AND HULL FORM

[75] Inventor: Dieter W. Czimmek, Yorktown, Va.

[73] Assignee: Newport News Shipbuilding and Dry Dock Company, Newport News, Va.

[21] Appl. No.: 753,391

[22] Filed: Aug. 30, 1991

[51] Int. Cl.[5] ..... B63B 35/08

[52] U.S. Cl. ..... 114/40

[58] Field of Search ..... 114/56, 40–42

[56] References Cited

U.S. PATENT DOCUMENTS 3,530,814 9/1970 Rastorguev ..... 114/40

4,715,305 12/1987 Wilkman et al. ..... 114/40

FOREIGN PATENT DOCUMENTS 2212147 9/1973 Fed. Rep. of Germany ..... 114/41

397421 1/1974 U.S.S.R. ..... 114/41

1204476 1/1986 U.S.S.R. ..... 114/40

*Primary Examiner*—Sherman Basinger

*Attorney, Agent, or Firm*—Lalos & Keegan

[57] ABSTRACT

An icebreaker ship has a V-shaped bow and an S-shaped stem line with a wedge extending from the bottom of the stem line below the design waterline of the ship towards the sides until maximum width is reached. The wedge is incorporated into the hull by means of a knuckle between the top of the wedge and the hull envelope of the ship. Upon breaking of the ice by the bow, the cusps of ice move downwardly into the water along the sides of the bow until the wedge is contacted. The cusps of ice are tripped and moved away from the ship's sides and under the unbroken ice, thus protecting the propellers and leaving a clearer channel behind the icebreaker.

23 Claims, 2 Drawing Sheets

ICEBREAKER BOW AND HULL FORM

INTRODUCTION AND BACKGROUND

This invention relates to the design of a bow and hull for an icebreaker designed to move through an ice field typically located in a polar region.

Ships designed for breaking channels in ice-covered waters have changed and improved over the decades but have always retained common characteristics and structural details to which are added the new and more effective hull forms and designs. In general, all icebreakers incorporate a section at the bow that differs from the typical deep V-shaped or U-shaped sections for non-icebreaking ships by reason of the bow being flatter in areas that are designed to contact the ice.

In one form of icebreaker, the bow is spoon-shaped, as shown in U.S. Pat. No. 4,702,187, for example. Relatively low resistance to breaking level ice is achieved with such a spoon-shaped bow but in the earlier days of use, there was insufficient power capability in the vessels to achieve the maximum benefits and efficiency from such a bow particularly in ice-clogged channels. Thus, the icebreaker bows were designed with a sharper angle that would move more easily in ice-clogged channels. As the ships were fitted with more powerful engines, the icebreakers were widened as well and, using relatively shallow drafts, the bow sections were flattened resulting in improved icebreaking capability and good advance in ice-clogged channels.

These previous designs had some success but a successful and efficient design for any icebreaker necessarily must consider the removal of the broken ice in the path of the ship. Ice may be broken by either bending, shearing or crushing. Bending is found to be the most common way of icebreaking using the downward force resulting from the weight of the ship. Crushing is not particularly efficient because the strength of the ice against crushing is considerably greater than against bending. Shearing is the most energy efficient wa of breaking ice but requires special hull forms and bow shapes.

The stem angle of a conventional icebreaker is usually the initial factor to consider because the stem angle determines the vertical force for bending the ice. A small stem angle maximizes the vertical force bending the ice. The average stem angle, that is the angle of the straight stem line with respect to the waterline, of conventional icebreakers has typically been in the range of 20°-30° with initial entrance angles at the design waterline as low as 15°. A step beyond this is a bow with an S-shaped stem line. This provides a low angle near the design waterline facilitating the breaking of level ice and an increased angle near the forefoot allowing the ship to ride up quicker onto the ice and slide off the ice more easily while ramming in heavy ice conditions. Such bow design, known as the North American White bow, is in use today on many icebreakers.

Most bows have been designed using the weight of the bow to bend the ice into breaking. This bending failure of the ice is found to generate cusps of ice that are rotated by the hull and pushed out of the path of the ship. The cusps are larger in thicker ice and are generated not only at the bow but all along the waterline to the point of maximum beam in level ice. Low icebreaking resistance hull forms often force the broken pieces downwardly. These pieces adhere to the hull by suction and tend to move slowly toward and through the ship's propellers and then into the broken channel behind the ship. The milling of these ice cusps by the propellers seriously reduces the performance of the propellers and the vessel requires additional power for the icebreaker to continue to meet the design capabilities of the ship.

Numerous methods have been tried and tested to achieve more effective control of the ice cusps after they have been broken and forced to the side of the ship. Ideally, such cusps should be forced to the side under the unbroken ice and not passed downward toward the stern of the ship and into the flow of water into the propellers.

As noted, spoon bow forms have been shown to have lower resistance to icebreaking than the White bow. Most spoon bow forms incorporate a straight stem at a low angle with straight parallel buttocks, a convex waterline and a large lateral radius to the stem. Compared to more wedge-shaped stems, however, spoon bows are at a disadvantage. A sharper stem is better in ridge ramming and provides directional stability during ramming and breaking out of an existing channel.

A number of specific bow shapes are well known to the art that are capable of maximizing certain characteristics for effective icebreaking but do not meet all of the requirements for efficient and effective icebreaking in polar regions. Of particular importance to this challenge are the following:

1. minimize the resistance to icebreaking in level ice of significant thickness;
2. provide good ramming capability and directional stability for breaking out of channels;
3. produce a clear channel behind the icebreaker;
4. minimize the amount of broken ice that reaches and contacts the propellers of the icebreaker.

To date, the prior art shows no effective hull and bow form for a polar icebreaker that both provides an effective icebreaking capability and controls the flow of ice away from the propellers so as to provide maximum icebreaker thrust.

OBJECTS OF THE PRESENT INVENTION

It is therefore a principal object of the present invention to design an icebreaker bow and hull that provide efficient and effective icebreaking.

Another object of the present invention is to provide for icebreaker bow and hull forms that produce low ice resistance during icebreaking.

Another important aspect of the present invention is the movement of the broken ice to the sides of the ship to avoid contact of the ice pieces with the propellers.

It is an object of the present invention to utilize a bow with an S-shaped stem line in combination with a knuckled wedge.

A further and more specific object of the present invention is the provision of a wedge-shaped forefoot incorporated with a knuckle, rather than being faired into the hull. The knuckle is designed to trip the cusps of ice sliding along the relatively flat hull and break the suction between these cusps and the hull. Buoyancy forces then cause them to rise under the unbroken ice at the sides of the ship.

SUMMARY OF THE INVENTION

A ship for breaking first and multi-year ice in polar regions is presented having a bow with sides extending along the outside of the ship. The bow is a V-shaped bow and has an S-shaped stem line with a wedge extending from the bottom of the stem line below the design waterline of the ship towards the sides until maximum width is reached. The wedge is incorporated into the hull by means of a knuckle between the top of the wedge and the sides of the ship. Upon breaking of the ice by the bow, the cusps of the ice move downwardly into the water along the sides of the bow. Suction holding the pieces of ice to the hull is overcome upon contact with the knuckle as the cusps of ice are tripped by the buoyancy force on them and moved out and away from the sides of the ship under the unbroken ice and thus away from the propellers.

DESCRIPTION OF THE PREFERRED EMBODIMENT

Figure 1:
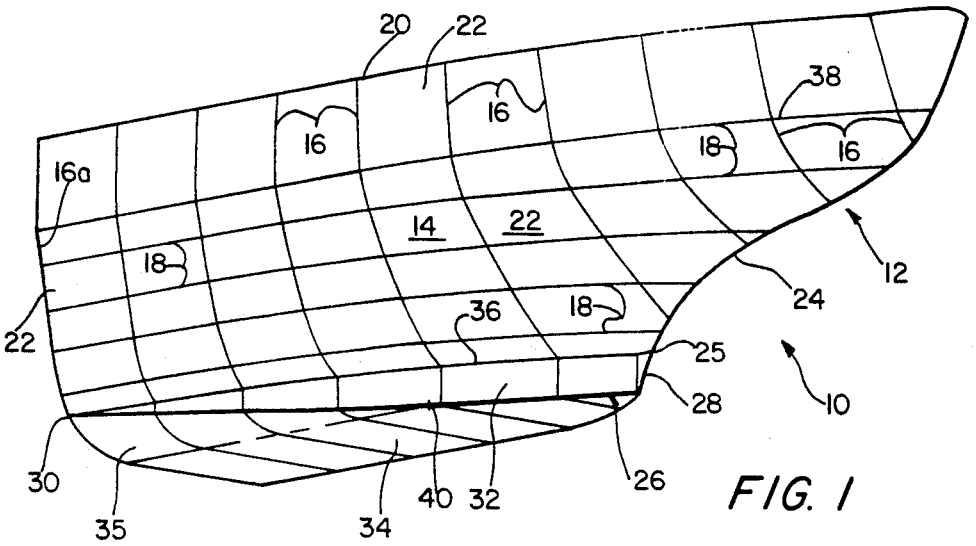
FIG. 1 is a perspective view partly broken away of the ship's hull including the bow of the icebreaker of the present invention and illustrating the deep bow and forefoot hook faired into the S-shaped stem line and the wedge extending aft and out to the maximum beam of the ship.
Figure 2:
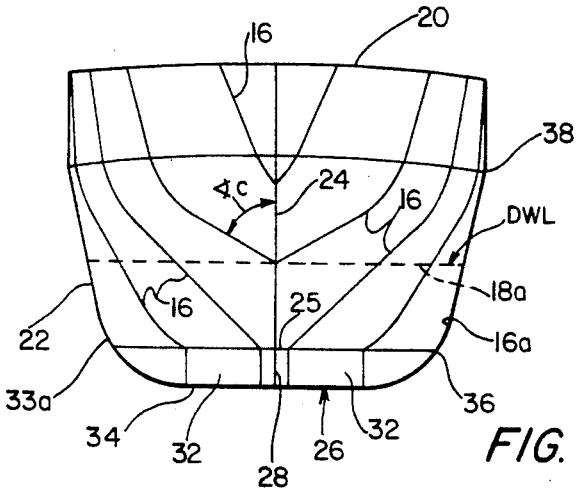
FIG. 2 is a bow view looking aft and illustrating the V-shape of the bow through the us of station lines and also illustrating the wedge and the knuckle formed by the wedge and the sides of the hull.

In FIG. 1 there is a perspective view of a forward portion of the icebreaker 10 exhibiting the present invention. A bow 12 and a hull 14 are shown, which are integral parts of the ship design of the icebreaker. For purposes of illustration and to show the shape of the structure of the hull 14 and the bow 12, conventional station lines 16 are drawn. These are intersections of the hull 14 by planes perpendicular to the longitudinal axis of the ship and to the surface of the water and are shown in FIGS. 1 and 2 only. The station lines 16 are crossed by waterlines 18 that ar parallel to the design waterline 18*a* of the ship.

The ship as shown in FIG. 1 also includes a deck line 20 at the top of FIGS. 1, 2, 3 and 5. The ship is formed below the deck line with sides 22 that are formed in the conventional manner for constructing a ship. The sides 22 form the hull 14 and are smooth, allowing for the curvature of the hull as plainly viewable from the drawings. As shown especially in FIG. 2, the sides of the parallel midbody have high flare angles of at least 6°, preferably 8°-10° or even up to 15° and greater.

Figure 3:
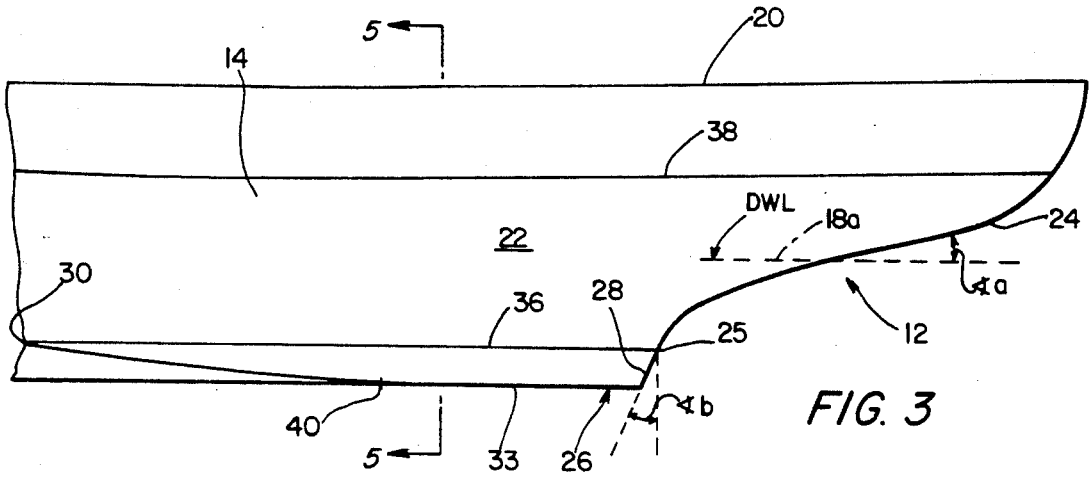
FIG. 3 is a side view partly broken away of the ship's hull showing the bow of the icebreaker of the present invention and also illustrating the knuckle and the wedge being faired into the S-shaped stem.
Figure 4:
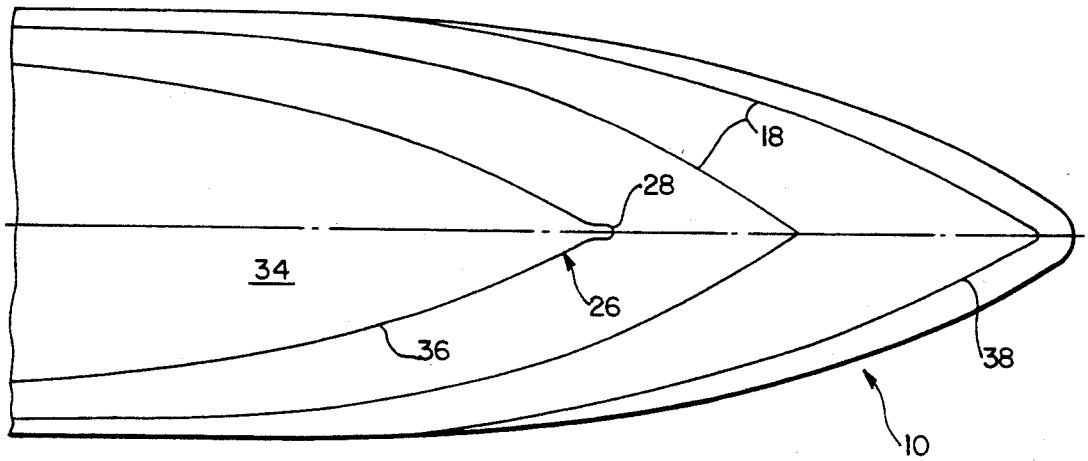
FIG. 4 is a bottom view of the bow of the icebreaker illustrating the shape of the bow and the wedge by means of waterlines.

The bow 12 is formed with a stem line 24 that is S-shaped in a side view as best seen in FIGS. 1 and 3. Icebreaker bows in which the stem line is S-shaped are known in the prior art. The United States Coast Guard POLAR Class and Canadian Coast Guard R class icebreakers have the S-shape, with a low stem angle at the design waterline increasing to a much steeper angle at the forefoot. The icebreaking tanker MANHATTAN had an S-shaped bow as shown in U.S. Pat. No. 221,406. This bow type has lower level ice resistance due to the low stem angle at the waterline, while the steeper angle near the forefoot allows the ship to slide off the ice more easily when ramming in heavy ice conditions. The present design having the S-shaped stem line shows a fine waterline entrance with a low stem angle, as shown in FIG. 3, at angle "a" illustrating the angle of the stem line 24 with a projection of the waterline 18*a*. The low stem angle is in the range of 13° to 22° or more broadly 10° to 25° with a preferable stem angle of about 15°.

As best shown in FIGS. 1 through 3 the bottom of the stem line below the point 25 forms a forefoot hook 28. This hook 28 prevents the ship from riding up too far onto the ice while ramming, increasing the danger of beaching herself. Note that while the forefoot hook 28 is at a slight angle "b" with the vertical of about 1° to 8°, as shown in FIG. 3, when the bow rises up onto the ice while ramming, the hook will be essentially vertical with respect to the plane of the ice sheet. Nevertheless, if it were desired the forefoot hook could be vertical with respect to the ship's baseline; this angle is not critical. The forefoot hook 28 also forms the leading edge of a wedge shaped structure 26.

The wedge 26 is of substantial height, is positioned above the baseline 33 of the ship and extends aft gradually widening out to the maximum width of the ship's bottom 33*a*, or nearly so, as shown at the approximate position of 30 forward of amidships. The sides 32 of the wedge 26 are essentially vertical. The bottom 34 of the wedge is essentially flat, unless the bottom 33*a* of the icebreaker is not flat either, in which case the bottom of the wedge follows the bottom contour of the ship. Also, the wedge bottom is not flat at its rear quarters 35 where it fairs into the hull. The wedge is symmetrical about the center line of the ship.

As is seen from FIGS. 1 through 3, rather than being faired in, the wedge meets the sides 22 of the hull at a knuckle 36. It is this knuckle 36 in combination with the smooth sides 22 of the hull 14 extending downwardly from shoulder 38 and the wedge 26 that is able to produce a significant control over the ice cusps that are broken by the bow and the S-shaped stem line 24.

The depth of the wedge 26 is constant from the forefoot 28 to a point 40 about a third of the length of the wedge behind the forefoot 28. The depth of wedge 26 is preferably about 75-125% and ideally 90-110% of the thickness of the level ice which the ship is designed to break on a continuous basis. Thus in a ship which is designed to break level 2.5 meter-thick ice on a continuous basis, the depth of wedge 26 in the section of constant depth should be 2.5 meters more or less.

Referring to FIG. 2, a V-shaped bow is one in which the station lines 16 forward of the forefoot 28 make relatively small angles to the stem line 24, such as angle c; these angles are known as spread angles. In the present invention as shown, these angles at or below the design waterline vary from about 40°-55°, near the forefoot to about 55°-70° and preferably 60°-65° at the design waterline for a spread angle range of 40°-70°. For a shallow bow, such as the spoon bow, the spread angles will be 75° or more. Such a shallow bow is shown in FIG. 1 of U.S. Pat. No. 3,931,780 where the station lines forward of the forefoot make very large angles with the stemline 15.

An advantage of the V-shaped bow is that the sides of the ship are steeper at the point where the cusps may tend to adhere to the hull by the buoyancy force and by the suction. This means that the component of the vertical buoyancy force, perpendicular to the station lines of the bow, which forces the cusps against the hull envelope or side, is less than it would be with a shallow bow. This makes it easier to break the suction of the ice pieces by the action of the wedge.

Figure 5:
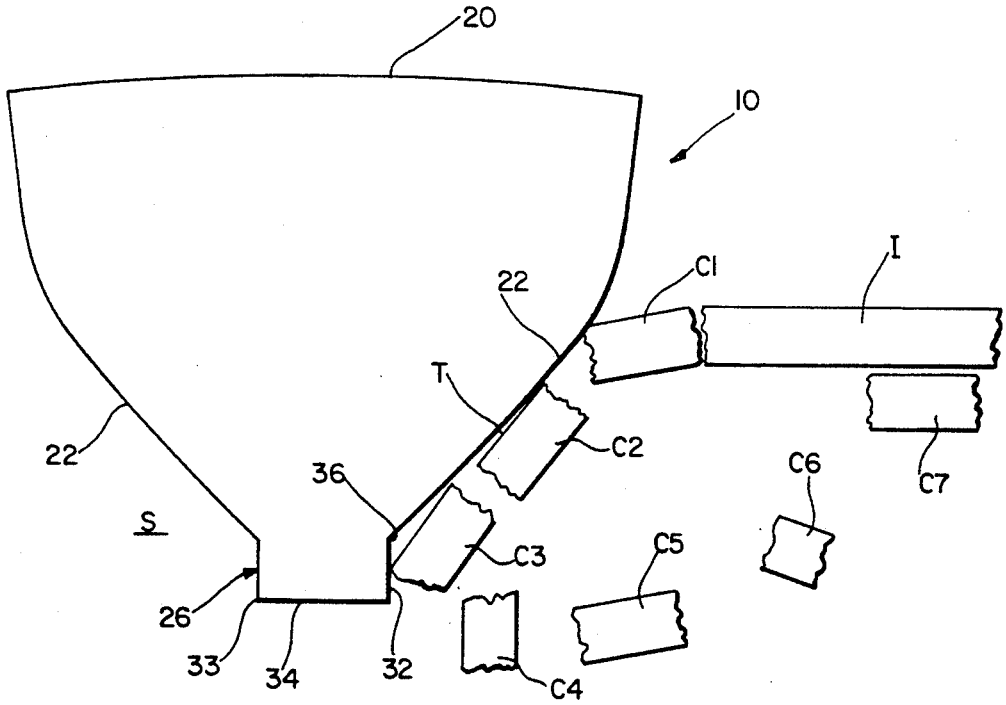
FIG. 5 is a schematic cross-sectional view of the icebreaker bow, taken along line 5—5 of FIG. 3, facing the bow of the ship as it moves through an ice-covered body of water and showing the action of the bow and the wedge in tripping the pieces of ice and pushing them aside.

The icebreaking function of the ship in accordance with the present invention is shown vividly in the schematic drawing of FIG. 5. This shows a cross section of the bow along the line 5—5 of FIG. 3. The ship 10 is in the sea S in the polar region where there are areas of level ice I of average thickness equal or less than the height of the wedge 26. As the icebreaker advances and breaks fields of level ice, cusps C of the ice I are broken off as shown in FIG. 5. These cusps are pushed downwardly by the V-shaped sides of the bow. Due to the suction at T between the top of the ice cusp C and the sides of the ship 22, the cusp "sticks" to the sides. For an icebreaker without the knuckled wedge of the invention, these cusps would continue to adhere to the hull of the ship and move aft along the bottom of the ship and along its inclined sides towards the stern and into the flow to the propellers.

This movement of the ice pieces is undesirable in at least two respects. In the first place, the ice pieces disturb the flow to the propellers, thus reducing their efficiency. When they subsequently strike the propellers they slow them down and cause wear and damage to the propeller blades as well. In the second place, the broken ice pieces remain in the channel where they impede the passage of following ships of a convoy and result in the channel refreezing faster than it would if it were clear of ice pieces.

However, in the present invention the ice cusps cross the knuckle 36 and strike the side 32 of the wedge 26 as they move downwardly along the side of the bow. This action trips the cusps away from the hull, thereby breaking the suction tending to hold the cusps against the hull, as shown in the sequential schematic among cusps $C_1$ through $C_4$. The buoyancy of the cusps then causes them to rise. As they rise, they are swept outwardly by the wedge 26 towards the underside of the sheet of ice I, as can be seen by the previously tripped ice cusps $C_5$–$C_7$ well out of the channel and away from the propellers of the ship. FIG. 5 also illustrates the importance of having relatively steep sides of the bow to assist in breaking the cusps away from the hull, as previously noted. For a shallower bow, the tendency for the cusps to adhere to the hull and to be carried to the propellers would be greater.

FIG. 5 further illustrates the significance of the height of the wedge 26 relative to the thickness of the ice. The design of any icebreaker is dictated to a large extent by the thickness of the ice in the area of operation. Normally, the icebreaker is designed so that it will break level ice of this thickness in a continuous mode at a desired speed. Of course, provisions are also made for other conditions that the ship may encounter, such as ridges of ice that are too thick to be broken in a continuous mode and therefore must be broken by repeated backing and ramming.

The tripping action described above takes place mainly in the area of the bow where the wedge 26 is of uniform height. To be effective, the height of wedge 26 in this area should be substantially the same as the maximum thickness of the ice in which the ship is designed to operate, as noted above. If the height of the wedge would be significantly less than the thickness of the ice, the broken ice cusps would tend to overrun the wedge and would not be tripped. A wedge shallower than the ice thickness would also be less effective in pushing the ice cusps to the side.

The wedge could be deeper than the ice thickness, which might increase its effectiveness. However, as in all cases of ship design, trade-offs are involved; making the wedge deeper than required has adverse effects on other characteristics of the ship and its performance.

The length of wedge 26 and of the section of constant height also may vary depending on the designer's priorities. The wedge could be carried back into the parallel midbody, or it could be terminated at a point forward of the parallel midbody. Normally, it should extend substantially the length of the forebody behind the forefoot hook 28 until it reaches the maximum width of the ship's bottom.

The length of the section of the wedge of constant height would depend on factors such as the total length of the wedge, the height of the wedge, the bilge radius, the stem angle, etc. In the preferred embodiment, as noted, it extends behind the forefoot hook 28 about one third the length of the wedge to point 40. This could vary between a quarter and a half the total length and still retain most of its effectiveness.

The bow of the ship being deep s that the bow is essentially V-shaped, having the S-shaped stem line 24, having a shallow stem angle, and having convex water lines with good flare forward enables the ship easily to ride u on the level ice where the weight of the ship will bend the ice and break it. The forefoot hook 28 will prevent the ship from being stranded on the ice during ramming a the forefoot hook would strike the edge of the ice that has not yet been broken and prevent the ship from moving forwardly over the top of unbroken ice. Then, as the ice is broken as the sides of the bow come into contact with the ice I, the cusps $C_1$ through $C_7$ are formed as previously described and are broken loose from the hull through the tripping action at the knuckle 36 and swept to the sides by the wedge 26 to lodge beneath the sheet of ice I.

The remainder of the ship not described here, including the stern, would follow state-of-the-art icebreaker lines of design enhancing the performance of the bow action and the overall icebreaker performance.

In view of the foregoing description, it is believed that all the objects of the present invention would be attained by a ship of the configuration described, and therefore the invention should be limited solely by the scope of the appended claims in which

I claim:

1. An icebreaker ship for breaking sheets of ice in a sea, said ship having, a bow, and sides extending along the outside of the ship, a bottom and a stern, said bow being a V-shaped bow, said bow having an S-shaped stem line, a wedge extending from said stem line below the sides of said ship towards the stern, a knuckle incorporated into the hull along and between the top of said wedge and said sides, the form and arrangement being such that as the bow of the ship breaks through a sheet of ice, the ice broken at the bow moves downwardly into the sea along the sides into contact with the knuckle where it is tripped to move out and away from the ship sides.

2. The icebreaker of claim 1 including,
said wedge with said knuckle extending aft to the point of maximum width of said bottom.

3. The icebreaker of claim 1 including, said wedge having substantially vertical sides.

4. The icebreaker of claim 1 including, a forefoot hook faired into the stem line.

5. The icebreaker of claim 4 including,
said V-shaped bow having station lines forward of said forefoot making angles of from about 40° to about 70° with said stem line at or below the design waterline.

6. The icebreaker of claim 5 including, said angles being about 40°-55° near the forefoot.

7. The icebreaker of claim 1 or 5 wherein,
said stem line makes an angle with the waterline in the range of 10°-25°.

8. The icebreaker of claim 4 including,
said forefoot hook forming the leading edge of said wedge.

9. The icebreaker of claim 4 including,
said V-shaped bow having station lines forward of said forefoot making angles of from about 40° to about 70° with said stem line at or below the design waterline, and
said wedge with said knuckle extending aft to the point of maximum width of said bottom.

10. The icebreaker of claim 4 including,
said V-shaped bow having station lines forward of said forefoot making angles of from about 40° to about 70° with said stem line at or below the design waterline,
said wedge with said knuckle extending aft to the point of maximum width of said bottom, and
the height of said wedge in its forward portion being from 75%-125% of the thickness of the level ice which said ship is designed to break in a continuous mode.

11. The icebreaker of claim 4 including,
said V-shaped bow having station lines forward of said forefoot making angles of from about 40° to about 70° with said stem line at or below the design waterline,
said wedge with said knuckle extending aft to the point of maximum width of said bottom, and
the height of said wedge being from 90%-110% of the thickness of the level ice which said ship is designed to break in a continuous mode.

12. The icebreaker of claim 4 including,
said V-shaped bow having station lines forward of said forefoot making angles of from about 40° to about 70° with said stem line at or below the design waterline,
said V-shaped bow having the station line at the design waterline making a spread angle in the range of 55°-70°.

13. The icebreaker of claim 4 including,
said V-shaped bow having station lines forward of said forefoot making angles of from about 40° to about 70° with said stem line at or below the design waterline,
the height of said wedge in its forward portion being from 75%-125% of the thickness of the level ice which said ship is designed to break in a continuous mode, and
said V-shaped bow having the station line at the design waterline making a spread angle in the range of 55°-70°.

14. The icebreaker of claim 4 including,
said V-shaped bow having station lines forward of said forefoot making angles of from about 40° to about 70° with said stem line at or below the design waterline,
the spread angle at the design waterline being in the range of about 60°-65°, and
the height of said wedge being from 90%-110% of the thickness of the level ice which said ship is designed to break in a continuous mode.

15. The icebreaker of claim 4 including,
said V-shaped bow having station lines forward of said forefoot making angles of from about 40° to about 70° with said stem line at or below the design waterline,
said wedge with said knuckle extending aft to the point of maximum width of said bottom,
the spread angle at the design waterline being in the range of 60°-65°, and
the height of said wedge being from 90%-110% of the thickness of the level ice which said ship is designed to break in a continuous mode.

16. The icebreaker of claim 4 wherein,
said V-shaped bow having station lines forward of said forefoot making angles of from about 40° to about 70° with said stem line at or below the design waterline,
the height of said wedge in its forward portion being from 75%-125% of the thickness of the level ice which said ship is designed to break in a continuous mode, and
said stem line makes an angle with the waterline in the range of 10°-25°.

17. The icebreaker of claim 1 including,
the height of said wedge in its forward portion being from 75%-125% of the thickness of the level ice which said ship is designed to break in a continuous mode.

18. The icebreaker of claim 17 including,
the height of said wedge being from 90%-110% of the thickness of the level ice which said ship is designed to break in a continuous mode.

19. The icebreaker of claim 1 including,
said V-shaped bow having the station line at the design waterline making a spread angle in the range of 55°-70°.

20. The icebreaker of claim 19 including,
said spread angle is in the range of about 60°-65°.

21. The icebreaker of claim 19 wherein,
said stem line makes an angle with the waterline in the range of 13°-22°.

22. The icebreaker of claim 1 including,
said wedge with said knuckle extending aft to the point of maximum width of said bottom, and
a forefoot hook faired into the stem line.

23. The icebreaker of claim 1 including,
said V-shaped bow having the station line at the design waterline making a spread angle in the range of 55°-70°, and
the height of said wedge in its forward portion being from 75%-125% of the thickness of the level ice which said ship is designed to break in a continuous mode.

* * * * *